US008749330B2

(12) United States Patent
Heinrich et al.

(10) Patent No.: US 8,749,330 B2
(45) Date of Patent: Jun. 10, 2014

(54) ELECTRIC CONTACT ELEMENT AND METHOD FOR PRODUCING AN ELECTRIC CONTACT ELEMENT

(75) Inventors: Jens Heinrich, Falkensee (DE); Ralf Hoffmann, Berlin (DE); Peter Sandeck, Berlin (DE); Martin Wieberger, Berlin (DE); Peter Braumann, Alzenau (DE); Andreas Koffler, Nidderau (DE); Bernd Kempf, Kleinwallstadt (DE); Allen Molvar, Bristol, RI (US)

(73) Assignees: Umicore AG & Co. KG, Hanau-Wolfgang (DE); Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 13/521,964

(22) PCT Filed: Jan. 14, 2011

(86) PCT No.: PCT/EP2011/050482

§ 371 (c)(1),
(2), (4) Date: Sep. 19, 2012

(87) PCT Pub. No.: WO2011/086167

PCT Pub. Date: Jul. 21, 2011

(65) Prior Publication Data

US 2013/0002380 A1 Jan. 3, 2013

Related U.S. Application Data

(60) Provisional application No. 61/295,530, filed on Jan. 15, 2010.

(30) Foreign Application Priority Data

Apr. 13, 2010 (DE) ..... 10 2010 014 745

(51) Int. Cl.
*H01H 51/22* (2006.01)

(52) U.S. Cl.
USPC ..... 335/83; 29/284

(58) Field of Classification Search
USPC ..... 335/83; 29/874–879; 200/268; 428/582
See application file for complete search history.

(56) References Cited

U.S. PATENT DOCUMENTS 2,433,687 A * 12/1947 Durst ..... 200/268
2,434,992 A * 1/1948 Durst ..... 428/602

(Continued)

FOREIGN PATENT DOCUMENTS

CH 607 729 A5 10/1978
DE 2 036373 A1 1/1972

(Continued)

OTHER PUBLICATIONS

International Search Report for PCT/EP2011/050482 mailed Apr. 18, 2011.

*Primary Examiner* — Bernard Rojas
(74) *Attorney, Agent, or Firm* — Smith, Gambrell & Russell, LLP

(57) ABSTRACT

The present invention relates to a method for producing an electric contact element from a semifinished product and to the electric contact element and the corresponding semifinished product. The method for producing an electric contact element (100), which can be electrically contacted by a mating contact, comprises the following steps: producing a wire (120) from a first electrically conductive material (112); coating the wire surface with a sheath (114) made of a second electrically conductive material; partially removing the sheath (114) in a direction along a longitudinal wire axis (118); forming at least one cylindrical semifinished product (110) by dividing the wire in a direction transverse to the longitudinal wire axis; fixing the semifinished product on a contact carrier (104) such that the second electrically conductive material is connected to the contact carrier; and reshaping the welded semifinished product so as to form the contact element (100), wherein a contact area (106), which is accessible for a mating contact, is formed by the first electrically conductive material.

19 Claims, 2 Drawing Sheets

(56) References Cited

U.S. PATENT DOCUMENTS

| | | | | |
|---|---|---|---|---|
| 3,775,067 | A | 11/1973 | Backstrom | |
| 4,706,383 | A * | 11/1987 | Saffari | 29/879 |
| 5,798,468 | A | 8/1998 | Weise et al. | |
| 5,985,440 | A | 11/1999 | Weise et al. | |
| 6,409,794 | B2 | 6/2002 | Wolmer et al. | |
| 7,566,437 | B2 | 7/2009 | Goia et al. | |
| 7,754,280 | B2 | 7/2010 | Kempf et al. | |
| 8,187,395 | B2 | 5/2012 | Uemura et al. | |

FOREIGN PATENT DOCUMENTS

| | | | |
|---|---|---|---|
| DE | 2259792 | A1 | 6/1973 |
| DE | 100 12 250 | A1 | 9/2001 |
| DE | 10 2007 040 171 | A1 | 2/2009 |
| EP | 0 508 055 | A1 | 10/1992 |
| EP | 0 725 154 | A1 | 8/1996 |
| EP | 0 736 885 | A2 | 10/1996 |
| EP | 0 795 367 | A1 | 9/1997 |
| EP | 1 142 661 | A2 | 10/2001 |
| EP | 1 505 164 | A2 | 2/2005 |
| EP | 1 915 765 | A1 | 4/2008 |
| EP | 2 004 349 | A2 | 12/2008 |
| FR | 2 931 303 | A1 | 11/2009 |
| WO | 2007/020007 | A1 | 2/2007 |
| WO | 2007/112924 | A2 | 10/2007 |

* cited by examiner

ELECTRIC CONTACT ELEMENT AND METHOD FOR PRODUCING AN ELECTRIC CONTACT ELEMENT

The present invention relates to a method for producing an electric contact element from a semifinished product and to the electric contact element and the corresponding semifinished product.

Electric contacts find multifarious application in electric devices and switchgear, such as in light switches, contact breakers or relays, and are widespread. High requirements are placed on the constituent parts of an electric contact that are involved in the switching operations, in particular on the contact layer, with regard to electric conductivity, wear resistance, mechanical stability and resistance to welding, above all under the action of temperature. It has been shown that these requirements, often determining the choice of material in a contradictory manner, can be satisfied particularly satisfactorily by noble metal/metal oxide composite materials.

However, it is precisely because of their resistance to welding that such noble metal/metal oxide composite materials, for example silver/tin oxide, cannot be fixed directly to a contact carrier material by welding.

It is therefore known to fix the contacts by means of riveting, such as is the case for example in what are known as bimetal rivets, or else to provide a weldable layer by building up a multilayer contact. Here, the connection is produced by a cold welding method or roll cladding. In these concepts, however, it is disadvantageous that a great deal of effort on fabrication is necessary and, moreover, the method necessitates a minimum volume needed for the contact material to be applied. In the case of solid contacts or in the case of wire section riveting, part of the noble metal is additionally not used for the actual switching function and thus not used as originally intended.

The object on which the present invention is based can therefore be viewed as specifying a method for producing a contact element which, firstly, ensures optimum characteristics of the contact element during operation and, secondly, ensures the ability to be produced in a material-saving and cost-effective manner.

This object is achieved by the subject matter of the independent patent claims, Advantageous developments of the present invention are the subject matter of the dependent patent claims.

The present invention is based on the idea that, for the production of the actual contact as a semifinished product, part of a wire made of metal composite material is used as a first conductive material, which is provided with a metal coating as a second. electrically conductive material, the metal coating on part of the surface having been removed again in order to expose the core of metal composite material on the subsequent contact area.

The metal composite material can consist of a suitable metal, such as copper, copper-nickel alloy, chromium-nickel alloy or silver, which contains oxides such as tin oxide, zinc oxide, iron oxide such as $Fe_2O_3$, copper oxide, cadmium oxide, indium oxide, antimony oxide, lanthanum oxide, magnesium oxide, manganese oxide, bismuth oxide, tellurium oxide, carbon (in the form of carbon blacks, graphite or carbon fibers), or else nickel if the metal is otherwise different from nickel. Particularly suitable metal composite materials are described, for example, in EP 508055, EP 1505164, EP 725154, EP 736885, EP 795367, DE 10012250, EP 1142661, EP 1915765 and EP 2004349 and the documents cited there. Advantageous in particular are the metal composite materials based on silver from EP 508055 and EP 1505164, to which reference is made. These are contact materials based on silver-tin oxide, which additionally can contain indium oxide, tellurium oxide, bismuth oxide, copper oxide, nickel oxide or mixtures thereof. Such materials can be produced by powder metallurgy or by means of internal oxidation.

The metal coating can consist of the same metal or metals as the metal composite material which forms the core but contains none of the ingredients which effect the welding strength of the metal composite material.

According to the present invention, the silver sheath of a silver tin oxide wire is removed from the region of the subsequent contact point by scraping or splitting. In this way, a minimal loss of noble metal is ensured and, at the same time, contamination of the switching component with the noble metal in the region of the contact point is avoided and thus welding of the switching contact is prevented.

On the other hand, as a result of the direct welding of the silver tin oxide contact material onto a contact carrier, the production can be simplified highly and the fabrication costs can be kept low. The use of noble metal is minimal, since the noble metal does not have to be used for mechanical tasks. There is no weldable metallic noble metal in the region of the switching point.

According to an advantageous embodiment of the present invention, part of the wire is scraped off in an axial direction, so that, on the circular cross section of the wire, one segment is removed. Following the division into cylindrical semifinished products and reshaping into an electric contact, the desired contact can be produced particularly simply in this way and with comparatively little loss of material. If it is wished to remove even more of the metallic sheath, further scraping steps can be carried out in a radially offset direction.

One embodiment in which no waste at all accumulates is provided when the wire is divided centrally and both parts remain usable.

The advantageous properties of the present invention come to fruition in particular when the contact element according to the invention is used in switchgear, such as for example an electromagnetic relay, since here the problem of welding is particularly critical.

For the purpose of a better understanding of the present invention, this will be explained in more detail by using the exemplary embodiments illustrated in the following figures. Identical parts are provided here with identical designations and identical component designations. Furthermore, some features or feature combinations from the embodiments shown and described can also represent inventive solutions, or solutions according to the invention, that are independent in themselves.

Figure 1:
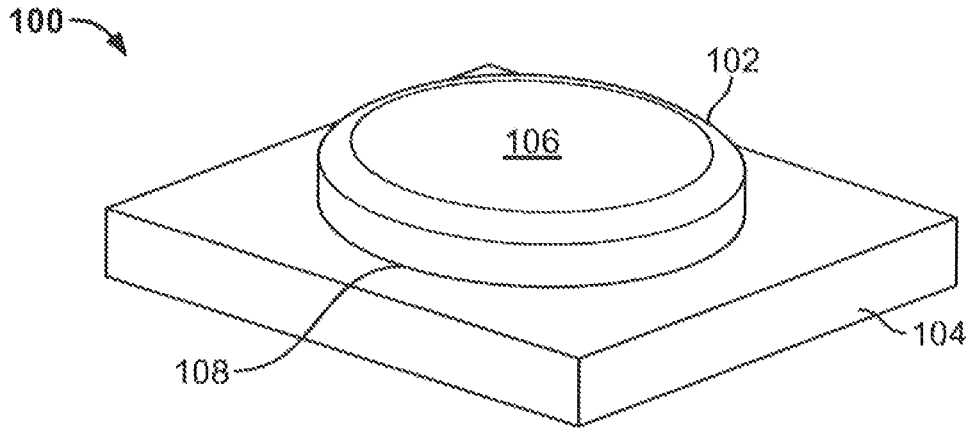
FIG. 1 shows a schematic perspective illustration of a finished contact element.

FIG. 1 shows a perspective illustration of the contact element 100 according to the invention by using the example of a relay contact. The actual electric contact 102 is connected to a contact carrier 104, illustrated only schematically here, by welding. The contact area 106 which, during operation, comes into electrical connection with a mating contact, is formed here by a material which exhibits no tendency to welding. According to the present embodiment, this is a silver-tin oxide composite material. However, other composite materials which contain cadmium oxide, indium oxide, zinc oxide, copper oxide, antimony oxide, lanthanum oxide, magnesium oxide, manganese oxide, bismuth oxide or tellurium oxide or a combination thereof, for example, are also suitable here. In the region of the welding point 108 there is a metal sheath 114, in particular a noble metal sheath, metallic silver in the present case, which makes it possible to fix the contact 102 to the carrier 104 by simple welding.

Figure 2:
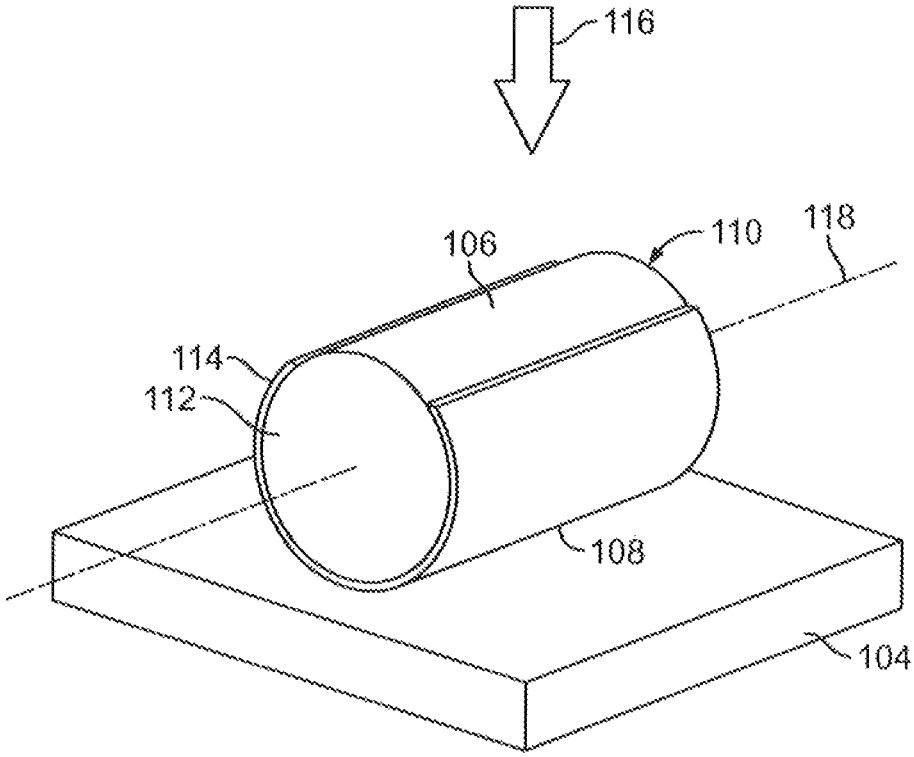
FIG. 2 shows a perspective illustration of the welded semifinished product according to the invention before reshaping.

FIG. 2 shows a perspective view of a prior stage of the contact 100, in which the semifinished product 110 according to the invention is fixed to the contact carrier 104.

As indicated schematically in FIG. 2, the semifinished product comprises a cylindrical noble metal/metal oxide core 112, which is partly surrounded by a metallic noble metal sheath 114. The sheath 114, which consists of a weldable material, is arranged in particular in the region of the welding point 108. On the other hand, the sheath has been removed in the region of the subsequent contact point 106. By exerting pressure in a direction 116 toward the contact carrier 104, the semifinished product 110 is subsequently reshaped into the actual contact 102. It should be noted here that the preshaping direction 116 runs transversely with respect to a longitudinal axis 118 of the piece of wire.

Figure 3:
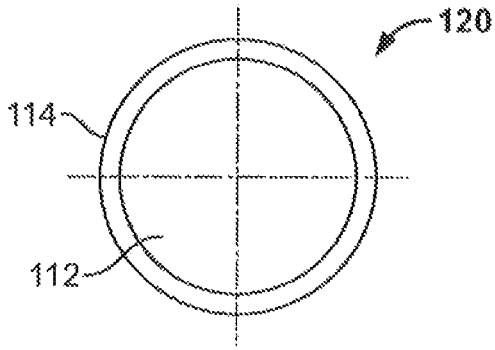
FIG. 3 shows a cross section of the sheathed wire before the scraping.
Figure 4:
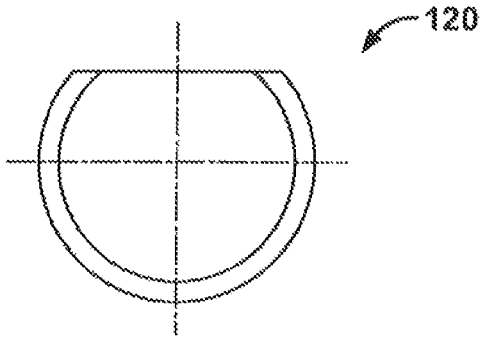
FIG. 4 shows a cross section of the wire after a first scraping step.

FIGS. 3 to 6 explain various specific possible ways of freeing the subsequent contact area 106 from the metallic silver layer. Here, in each case, a section is shown through the wire 120, from which the semifinished product 110 is produced by cutting transversely with respect to its longitudinal axis. FIG. 3 shows the unfinished part; in which a core 112, which, as already explained, can consist for example of silver-tin oxide composite material, is surrounded with a metallic noble metal sheath 114. The noble metal is, for example, metallic silver. As shown in FIG. 4, the partial removal of the metallic sheath layer 114 can be carried out by scraping off a segment of the cross section.

Figure 5:
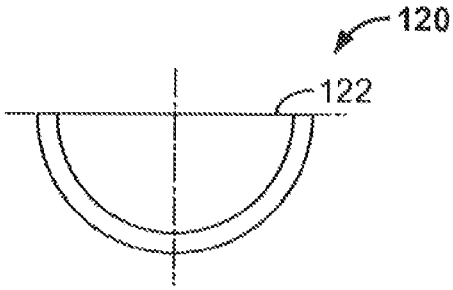
FIG. 5 shows a cross section of the wire after a splitting step.

Alternatively, it is possible either to scrape as far as the center 122 of the wire 120 or for the wire to be divided into two halves, as illustrated in FIG. 5. Although the variant shown in FIG. 5 offers the advantage as a semifinished product of offering the largest possible silver-free contact area 106, it has the disadvantage that a comparatively large amount of material is lost if this cross section is produced by scraping. However, if a splitting method is used, in which both halves of the wire remain usable, this variant represents the solution saving the most material.

Figure 6:
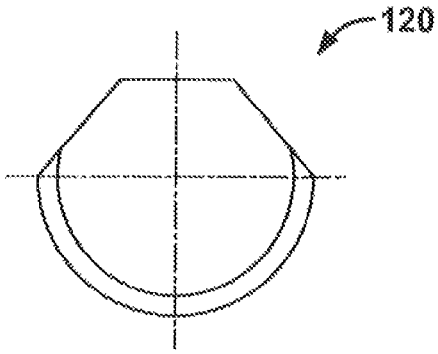
FIG. 6 shows a cross section of the wire after a plurality of scraping steps have been carried out.

FIG. 6 shows an embodiment in which as much as possible of the metallic silver sheath 114 is removed from the subsequent contact area by two further scraping steps being carried out in a direction offset radially with respect to the first scraping step.

In the following table 1, for the versions of FIGS. 4, 5 and 6, the respective material losses in relation to the cross-sectional area are compared for the case in which a wire diameter of about 1.2 mm with a silver coating of 40 μm is considered.

TABLE 1

| | Unfinished part | FIG. 4 | FIG. 5 | FIG. 6 |
|---|---|---|---|---|
| Sheath | 0.4084 $mm^2$ | 0.301 $mm^2$ | 0.2042 $mm^2$ | 0.2173 $mm^2$ |
| Loss of sheath | 0% | 26% | 50% | 47% |
| Core | 1.131 $mm^2$ | 1.0413 $mm^2$ | 0.5655 $mm^2$ | 1.0426 $mm^2$ |
| Loss of core | 0% | 8% | 50% | 8% |
| Total | 1.5393 $mm^2$ | 1.3423 $mm^2$ | 0.7697 $mm^2$ | 1.2599 $mm^2$ |
| Total loss | 0% | 13% | 50% | 18% |

As becomes clear from this overview, the lowest loss of material is to be recorded in the variant of FIG. 4, while the variant of FIG. 6, however, contains the most effective removal of the sheath material.

In summary, it is possible to record that the production according to the invention of contact elements, for example for switching or carrying contacts on relays, firstly permits the ability to be produced simply by means of the direct welding of the silver-tin oxide contact material but, secondly, ensures a particularly low tendency to welding in the region of the actual electric contact. By means of the economical use of starting materials containing noble metals, the costs can be reduced further.

| List of designations | |
|---|---|
| 100 | Contact element |
| 102 | Electric contact |
| 104 | Contact carrier |
| 106 | Contact area |
| 108 | Welding point |
| 110 | Semifinished product |
| 112 | Core |
| 114 | Sheath |
| 116 | Direction of the reshaping pressure |
| 118 | Longitudinal axis of the wire |
| 120 | Wire |
| 122 | Center of the wire cross section |

The invention claimed is:

1. A method for producing an electric contact element, with which electric contact can be made by a mating contact, the method comprising the following steps:

manipulating a wire of a first electrically conductive material, the wire having a sheath of a second electrically conductive material, to partially remove the sheath in a direction along a wire longitudinal axis;

forming at least one cylindrical semifinished product by subdividing the wire in a direction transverse with respect to the wire longitudinal axis;

fixing the semifinished product to a contact carrier, so that the second electrically conductive material is connected to the contact carrier;

reshaping the fixed semifinished product to form the contact element with a contact area which is accessible to a mating contact, the contact area being formed of the first electrically conductive material, wherein the step of the partial removal of the sheath in a direction along the wire longitudinal axis comprises scraping off part of the wire in an axial direction, so that, on the circular cross section of the wire, one segment is removed.

2. The method as claimed in claim 1, wherein the step of the partial removal of the sheath in a direction along the wire longitudinal axis further comprises scraping off part of the wire in an axial direction offset by a defined radial angle with respect to the preceding scraping-off step, so that, on the circular cross section of the wire, at least one further segment is removed.

3. The method as claimed in claim 1, the first electrically conductive material being non-weldable.

4. The method as claimed in claim 3, the first electrically conductive material comprising a noble metal/metal oxide alloy.

5. The method as claimed in claim 1, the second electrically conductive material being weldable.

6. The method as claimed in claim 5, the second electrically conductive material comprising elementary noble metal.

7. The method as claimed in claim 1, the contact element being a contact for an electromagnetic relay.

8. The method as claimed in claim 1, the step of fixing the semifinished product to the contact carrier being carried out by means of welding.

9. The method as claimed in claim 1, the cylindrical semifinished product being fixed, in the step of fixing the semifinished product to the contact carrier, with its circumferential cylindrical surface on the contact carrier in such a way that the region in which the sheath has been removed faces away from the contact carrier.

10. An electric contact element with which electrical contact can be made by a mating contact, the contact element being produced by means of a method as claimed in claim 1.

11. The method as claimed in claim 1, wherein the first electrically conductive material is a metal composite material that includes a metal containing oxides, said metal being selected from the group consisting of copper, copper-nickel alloy, chromium-nickel alloy, silver, and combinations thereof, said oxide being selected from the group consisting of tin oxide, zinc oxide, iron oxide, $Fe_2O_3$, copper oxide, cadmium oxide, indium oxide, antimony oxide, lanthanum oxide, magnesium oxide, manganese oxide, bismuth oxide, tellurium oxide, carbon, carbon black, graphite, carbon fibers, and combinations thereof.

12. A method for producing an electric contact element, with which electric contact can be made by a mating contact, the method comprising the following steps:

manipulating a wire of a first electrically conductive material, the wire having a sheath of a second electrically conductive material, to partially remove the sheath in a direction along a wire longitudinal axis;

forming at least one cylindrical semifinished product by subdividing the wire in a direction transverse with respect to the wire longitudinal axis;

fixing the semifinished product to a contact carrier, so that the second electrically conductive material is connected to the contact carrier;

reshaping the fixed semifinished product to form the contact element with a contact area which is accessible to a mating contact, the contact area being formed of the first electrically conductive material, wherein the step of the partial removal of the sheath in a direction along the wire longitudinal axis comprises splitting the wire in an axial direction, so that the circular cross section of the wire is divided.

13. A semifinished product for producing an electric contact element, the semifinished product comprising a core of a first electrically conductive material and a sheath of a second electrically conductive material, the sheath being at least partly removed in a direction along a longitudinal axis of the semifinished product, wherein with respect to a cross-section perpendicular to the longitudinal axis of the semifinished Product, the percentage of sheath retention following partial removal of the sheath is at or exceeds 50%.

14. The semifinished product as claimed in claim 13, the semifinished product having a cylindrical shape.

15. A method of producing a contact element comprising fixing the semifinished product as claimed in claim 13 to a contact carrier and, while the semifinished product is fixed, processing the semifinished product into a contact element having an exposed contact area.

16. A method of producing an electromagnetic relay comprising including in assembly of the electromagnetic relay the contact element produced according to claim 15 as a switchable electrical contact element.

17. A method of producing the semifinished product of claim 13 comprising manipulating a wire having the core of the first electrically conductive material and the sheath of the second electrically conductive material to partially remove the sheath in a direction along a wire longitudinal axis; and subdividing the wire in a direction transverse with respect to the wire longitudinal axis to produce the semifinished product.

18. The semifinished product of claim 17, wherein the first electrically conductive material is a metal composite material that includes a metal containing oxides.

19. The semifinished product of claim 13, wherein the first electrically conductive material is a metal composite material that includes a metal containing oxides.

* * * * *